US011699405B2

(12) United States Patent
Wang et al.

(10) Patent No.: US 11,699,405 B2
(45) **Date of Patent: *Jul. 11, 2023**

(54) METHODS FOR COMPENSATING COLORS BASED ON VIRTUAL CHROMATICITY COORDINATE POINTS AND THE RELATED DISPLAY DEVICES

(71) Applicant: DYNASCAN TECHNOLOGY CORP., Taoyuan (TW)

(72) Inventors: Tsun-I Wang, Taoyuan (TW); Ching-Chun Wu, Taoyuan (TW); Chia-Liang Yang, Taoyuan (TW)

(73) Assignee: DYNASCAN TECHNOLOGY CORP., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/733,406

(22) Filed: Apr. 29, 2022

(65) Prior Publication Data

US 2022/0351693 A1 Nov. 3, 2022

Related U.S. Application Data

(60) Provisional application No. 63/183,476, filed on May 3, 2021.

(51) Int. Cl.
*G09G 3/20* (2006.01)
*G09G 3/34* (2006.01)

(52) U.S. Cl.
CPC ..... *G09G 3/3426* (2013.01); *G09G 3/2003* (2013.01); *G09G 2320/0233* (2013.01);
(Continued)

(58) Field of Classification Search
CPC ..... G09G 3/2003; G09G 3/3426; G09G 2320/0233; G09G 2320/0242; G09G 2320/0646
See application file for complete search history.

(56) References Cited

U.S. PATENT DOCUMENTS 6,313,816 B1 11/2001 Kojima
8,643,589 B2 2/2014 Wang
(Continued)

FOREIGN PATENT DOCUMENTS

CN 1508771 A 6/2004
CN 104409019 A 3/2015
(Continued)

OTHER PUBLICATIONS

International Search Report and Written Opinion in International Patent Application No. PCT/CN2022/090177, dated Jun. 28, 2022, in 10 pages.
(Continued)

*Primary Examiner* — Gene W Lee
(74) *Attorney, Agent, or Firm* — Duane Morris LLP

(57) ABSTRACT

Disclosed are methods for compensating colors based on virtual chromaticity coordinate points and the related display devices. The present disclosure provides an electronic device. The electronic device comprises: a display comprising an array of pixels and a control circuit electrically connected to the display. Pixels in the array comprise a plurality of first sub-pixels defining a first color area on a chromaticity plane, a plurality of second sub-pixels defining a second color area on the chromaticity plane, and a plurality of third sub-pixels defining a third color area on the chromaticity plane. The control circuit is configured to receive an input image signal and generate a control signal to the display for driving each pixel of the display to output light in a virtual color gamut. The virtual color gamut of the display is among the first, second and third color areas on the chromaticity plane and does not overlap any of the first, second or third color areas.

13 Claims, 7 Drawing Sheets

(52) U.S. Cl.
CPC ..... *G09G 2320/0242* (2013.01); *G09G 2320/0646* (2013.01)

(56) References Cited

U.S. PATENT DOCUMENTS

| | | | | |
|---|---|---|---|---|
| 8,766,893 | B2 | 7/2014 | Wang | |
| 10,210,786 | B2 * | 2/2019 | Seo | G09G 3/2003 |
| 2010/0110098 | A1 | 5/2010 | Wang | |
| 2012/0120096 | A1 | 5/2012 | Johnson | |
| 2012/0287143 | A1 | 11/2012 | Brown Elliott | |
| 2013/0215360 | A1 * | 8/2013 | Pollack | G09G 3/3426 349/61 |
| 2016/0381254 | A1 | 12/2016 | Poree | |
| 2017/0116955 | A1 | 4/2017 | Stauder | |
| 2017/0213491 | A1 * | 7/2017 | Seo | G09G 3/2003 |

FOREIGN PATENT DOCUMENTS

| | | | |
|---|---|---|---|
| CN | 108399901 | A | 8/2018 |
| CN | 110377391 | A | 10/2019 |
| JP | 2000155548 | A | 6/2000 |
| JP | 2017072754 | A | 4/2017 |
| TW | 480879 | B | 3/2002 |
| TW | I416454 | B | 11/2013 |
| WO | 2006069117 | A2 | 6/2006 |

OTHER PUBLICATIONS

International Search Report and Written Opinion in International Patent Application No. PCT/CN2022/090182, dated Jun. 30, 2022, in 11 pages.

* cited by examiner

METHODS FOR COMPENSATING COLORS BASED ON VIRTUAL CHROMATICITY COORDINATE POINTS AND THE RELATED DISPLAY DEVICES

FIELD OF THE INVENTION

The present invention relates to a method of controlling or operating a display, and more particularly, to a method of compensation of a display.

BACKGROUND

A liquid crystal display (LCD) mainly includes a backlight at its rear side and a liquid crystal module at its front side. An image of the LCD is displayed by allowing the light emitted from the backlight to pass through several color filters disposed in front of the backlight to thereby generate three primary colors of red, green and blue at corresponding liquid-crystal valves disposed in the liquid crystal module, followed by using electrical signals to control the voltage between the electrodes disposed at two sides of respective liquid-crystal valves to thereby alter the light transmission ratio across the liquid crystals interposed between the electrodes. For illustrative purposes, a liquid-crystal valve is herein called a sub-cell. The red, green and blue light beams passing through the respective three sub-cells are mixed to constitute a color pixel. An entire picture is a combination of the brightness and chromaticity presented at respective pixel locations.

There are two ways of using LEDs as a backlight source: one is integrating a blue light LED with a phosphor powder, wherein the phosphor powder is excited to convert the blue light into a light having a longer wavelength so as to synthesize white light for illumination; the other is directly combining RGB LED chips to constitute a white light LED. However, regardless of the types of white light LEDs, the brightness and chromaticity values always vary from one LED die to another. For example, in the case of a white light LED integrating a blue light chip with a phosphor powder, the brightness and chromaticity of white light emitted from the LED will be affected by factors such as the wavelength of the blue light and the composition and mixture condition of the phosphor powder. As such, in the same batch of products, some LEDs may emit yellowish white light while others produce bluish white light, causing the light emitted from LED products to migrate within a range between 0.26 and 0.36 as defined by the Chromaticity Coordinates.

Similarly, in the case of a white light LED device that combines RGB LED chips, the mixed white light emitted therefrom varies as measured by the Chromaticity Coordinates system due to the diversity in chromaticity of respective LED dies.

As the brightness and chromaticity vary from one light source to another, the backlight may still fail to provide uniform emanating light even if a diffuser is placed in the light path. It is assumed that the i-th cell in a liquid crystal module has a primary backlight source of $LED_i$ and the i+1-th cell has a primary backlight source of $LED_{i+1}$. If $LED_i$ generates a reddish light and the $LED_{i+1}$ emits a bluish light, the pixel corresponding to the i-th cell may be reddish and the pixel corresponding to the i-th cell may be bluish when the display device displays a full white image. Hence, the overall brightness and chromaticity of the image shown on the display device are rendered non-uniform.

SUMMARY OF THE INVENTION

The present disclosure provides a method of selecting preferable virtual color coordinate points for compensating a non-uniform color display.

A screen of a display usually consists of a huge number of pixels. A pixel of a color display may emit lights of three primary colors and mixed lights composed of three primary colors. However, some display techniques may cause uneven colors. For example, the entire screen is expected to display a given primary color with the same brightness level, but the screen presents different colors at different regions. Once a given primary color cannot be uniformly displayed over the entire display screen, the displayed colors are distorted. This phenomenon is one of the main factors that causes the quality of an LED (light emitting diode) display to deteriorate. Optical and electrical characteristics of different LEDs are diverse, such that the color uniformity of the associated LED display may not be good. With a method of virtual primary colors, the foregoing problems of an LED color display may be solved. However, how to uniformly display primary colors with virtual primary colors is indeed a problem to be solved.

An embodiment of the present disclosure provides an electronic device comprising: a display comprising an array of pixels and a control circuit electrically connected to the display. Pixels in the array comprise a plurality of first sub-pixels defining a first color area on a chromaticity plane, a plurality of second sub-pixels defining a second color area on the chromaticity plane, and a plurality of third sub-pixels defining a third color area on the chromaticity plane. The control circuit is configured to receive an input image signal and generate a control signal to the display for driving each pixel of the display to output light in a virtual color gamut. The virtual color gamut of the display is among the first, second and third color areas on the chromaticity plane and does not overlap any of the first, second or third color areas.

Another embodiment of the present disclosure provides a method of operating a display. The method comprises: receiving an input image signal for the display; and generating a control signal based on the input image signal and a compensation matrix to drive the display. The display comprises an array of pixels. The display is configured to output light in a virtual color gamut according to the control signal. Pixels in the array comprise a plurality of first sub-pixels defining a first color area on a chromaticity plane, a plurality of second sub-pixels defining a second color area on the chromaticity plane and a plurality of third sub-pixels defining a third color area on the chromaticity plane. The virtual color gamut of the display is among the first, second and third color areas on the chromaticity plane, and does not overlap any of the first, second or third color areas.

A further embodiment of the present disclosure provides a method for compensating colors of a display. The display comprises an array of pixels. Pixels in the array comprise a plurality of first sub-pixels, a plurality of second sub-pixels and a plurality of third sub-pixels. The method comprises: determining chromaticity coordinate points of the plurality of first sub-pixels, the plurality of second sub-pixels, and the plurality of third sub-pixels; determining a first virtual chromaticity coordinate point on a chromaticity plane based on the chromaticity coordinate points of the plurality of first sub-pixels, determining a second virtual chromaticity coordinate point on the chromaticity plane based on the chromaticity coordinate points of the plurality of second sub-pixels, and determining a third virtual chromaticity coordinate point on the chromaticity plane based on the chromaticity coordinate points of the plurality of third sub-pixels; and calculating a compensation matrix based on the virtual chromaticity coordinate points for compensating colors of the display.

BRIEF DESCRIPTION OF THE DRAWINGS

In order to describe the manner in which advantages and features of the present disclosure can be obtained, a description of the present disclosure is rendered by reference to specific embodiments thereof, which are illustrated in the appended drawings. These drawings depict only example embodiments of the present disclosure and are not therefore to be considered limiting of its scope.

DETAILED DESCRIPTION

Figure 1A:
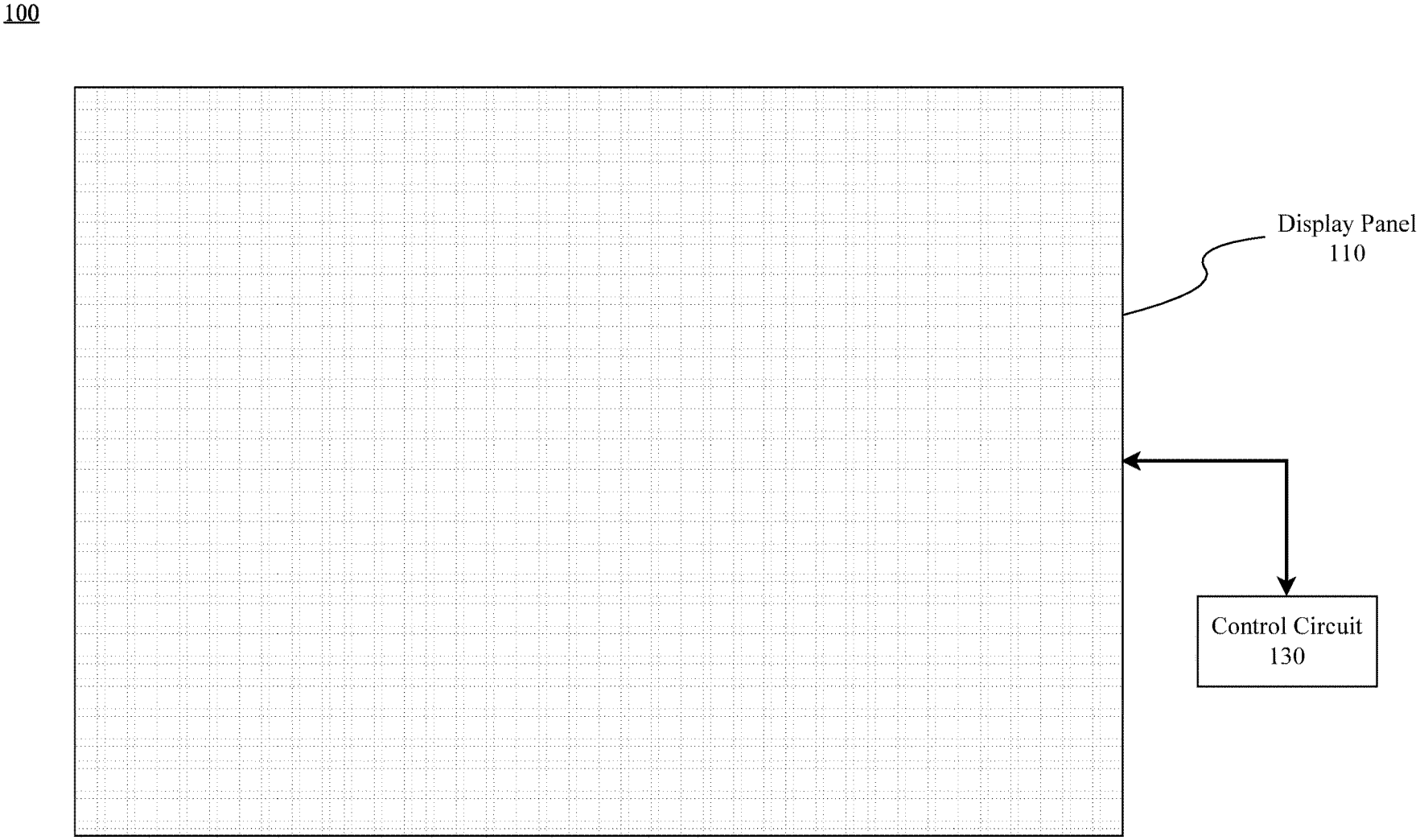
FIG. 1A illustrates a schematic diagram of an electronic display according to some embodiments of the present disclosure.

The following disclosure provides many different embodiments, or examples, for implementing different features of the provided subject matter. Specific examples of operations, components, and arrangements are described below to simplify the present disclosure. These are, of course, merely examples and are not intended to be limiting. For example, a first operation performed before or after a second operation in the description may include embodiments in which the first and second operations are performed together, and may also include embodiments in which additional operations may be performed between the first and second operations. For example, the formation of a first feature over, on or in a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Time relative terms, such as "prior to," "before," "posterior to," "after" and the like, may be used herein for ease of description to describe one operation or feature's relationship to another operation(s) or feature(s) as illustrated in the figures. The time relative terms are intended to encompass different sequences of the operations depicted in the figures. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. Relative terms for connections, such as "connect," "connected," "connection," "couple," "coupled," "in communication," and the like, may be used herein for ease of description to describe an operational connection, coupling, or linking one between two elements or features. The relative terms for connections are intended to encompass different connections, coupling, or linking of the devices or components. The devices or components may be directly or indirectly connected, coupled, or linked to one another through, for example, another set of components. The devices or components may be wired and/or wireless connected, coupled, or linked with each other.

As used herein, the singular terms "a," "an," and "the" may include plural referents unless the context clearly indicates otherwise. For example, reference to a device may include multiple devices unless the context clearly indicates otherwise. The terms "comprising" and "including" may indicate the existences of the described features, integers, steps, operations, elements, and/or components, but may not exclude the existences of combinations of one or more of the features, integers, steps, operations, elements, and/or components. The term "and/or" may include any or all combinations of one or more listed items.

Additionally, amounts, ratios, and other numerical values are sometimes presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified.

The nature and use of the embodiments are discussed in detail as follows. It should be appreciated, however, that the present disclosure provides many applicable inventive concepts that can be embodied in a wide variety of specific contexts. The specific embodiments discussed are merely illustrative of specific ways to embody and use the disclosure, without limiting the scope thereof.

FIG. 1A illustrates a schematic diagram of an electronic display 100 according to some embodiments of the present disclosure. The electronic display 100 may include a display panel 110. The display panel 110 may be made of an array of color light emitting diodes (LEDs) or an array of organic light emitting diodes (OLEDs).

In some embodiments, the display panel 110 may be a liquid crystal panel, and a corresponding backlight module would be necessary. The backlight module may be a layer-shaped module disposed behind the liquid crystal panel. The backlight module can provide light passing though the liquid crystal panel. The backlight module may be arranged around the liquid crystal panel. The backlight module may be made of light emitting diodes or other suitable light sources.

The display panel 110 can be coupled, connected, or in communication with a control circuit 130. The control circuit 130 can control the display panel 110 and/or a backlight module. The control circuit 130 can be configured to receive an input image signal and generate a control signal to the display for driving each pixel of the display to output corresponding color lights.

Figure 1B:
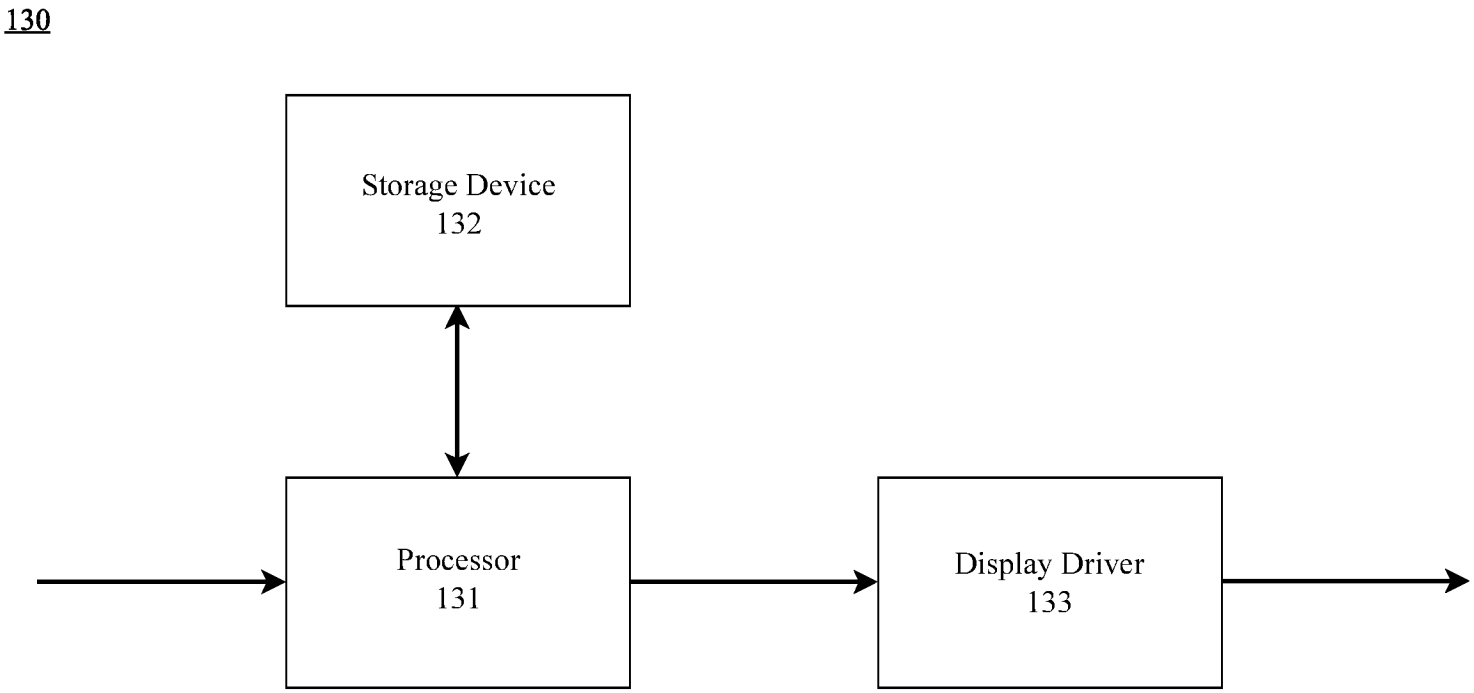
FIG. 1B illustrates a schematic diagram of a control circuit according to some embodiments of the present disclosure.

FIG. 1B illustrates a schematic diagram of the control circuit 130 according to some embodiments of the present disclosure. The control circuit 130 may include a processor 131, a storage device 132, and a display driver 133. Input image data to be displayed can be input to the processor 131. The processor 131 may transform the input image data into an output image data based on the transformation matrix (e.g., a compensation matrix) stored in the storage device 132. The display driver 133 may receive the output image data from the processor 131. The display driver 133 may generate control signals based on the received output image data and output the control signals to the liquid crystal panel 110 and the backlight module 120.

The electronic display 100 or the liquid crystal panel 110 may include an array of pixels. Each pixel may include a set of a plurality of sub-pixels. For example, each pixel of a display may include a set of red, green, and blue (R, G, B) sub-pixels, a set of red, green, blue, and yellow (R, G, B, Y) sub-pixels, or a set of red, green, blue, and white (R, G, B, W) sub-pixels.

Figure 2A:
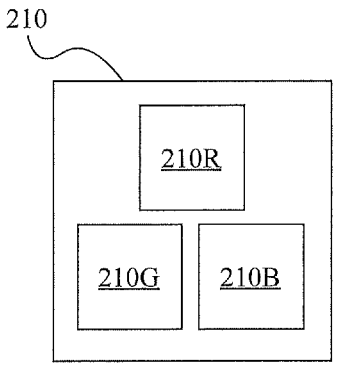
FIGS. 2A-2D illustrate schematic diagrams of different sub-pixel arrangements according to some embodiments of the present disclosure.
Figure 2B:
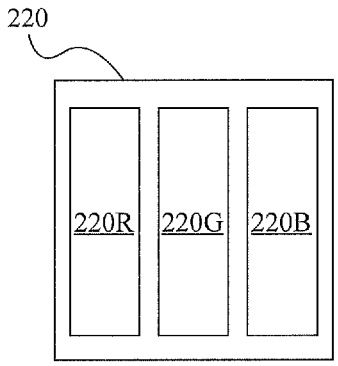

FIGS. 2A-2D illustrate schematic diagrams of different sub-pixel arrangements in one pixel. FIG. 2A illustrates an exemplary pixel 210. The pixel 210 may include sub-pixels 210R, 210G, and 210B, which indicate red, blue, and green sub-pixels. The sub-pixels 210R, 210G, and 210B can emit red light, green light, and blue light, respectively. FIG. 2B illustrates an exemplary pixel 220. The pixel 220 may include vertically arranged sub-pixels 220R, 220G, and 220B, which indicate red, blue, and green sub-pixels. The sub-pixels 220R, 220G, and 220B can emit red light, green light, and blue light, respectively.

Figure 2C:
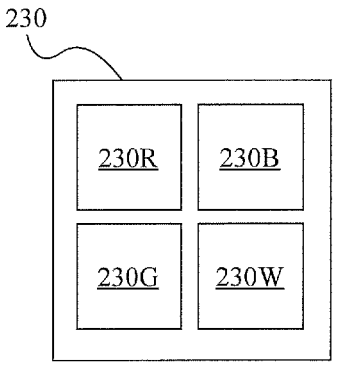
Figure 2D:
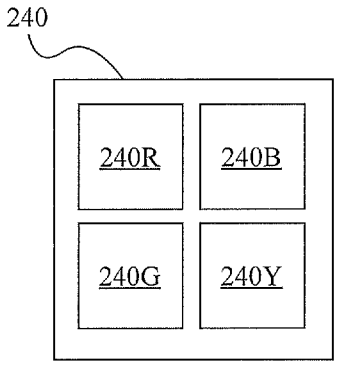

FIG. 2C illustrates an exemplary pixel 230. The pixel 230 may include sub-pixels 230R, 230G, 230B, and 230W, which indicate red, blue, green, and white sub-pixels. The sub-pixels 230R, 230G, 230B, and 230W can emit red light, green light, blue light, and white light, respectively. FIG. 2D illustrates an exemplary pixel 240. The pixel 240 may include sub-pixels 240R, 240G, 240B, and 240Y, which indicate red, blue, green, and yellow sub-pixels. The sub-pixels 240R, 240G, 240B, and 240Y can emit red light, green light, blue light, and yellow light, respectively.

As shown in FIGS. 2A-2D, each pixel of a display may include a plurality of monochrome elements (or sub-pixels). The lights of the plurality of monochrome elements (or sub-pixels) may be mixed to display different colors and brightness levels.

The chromaticity levels of the monochrome elements of different pixels over the entire screen may not be consistent. The case of non-uniform chromaticity levels may be caused when displaying the same monochrome or the same mixed color over the entire screen. In order to solve this problem, the techniques of virtual color coordinate points may be used. In the techniques of virtual color coordinate points, other monochrome elements can assist to compensate when a monochrome is displayed such that the chromaticity levels of the pixels over the entire screen are consistent.

In some embodiments, assuming that the saturation of the raw red color of a given pixel is much higher than other pixels, green color and blue color may be used to assist compensation when the given pixel is going to present the primary red color such that the given pixel eventually is presented as a pixel having lower saturation of red color. In this way, when the given pixel presents the primary red color, the chromaticity level of the primary red color of the given pixel is close to those of the primary red of other pixels such that the color of the entire screen is consistent and even.

Figure 3A:
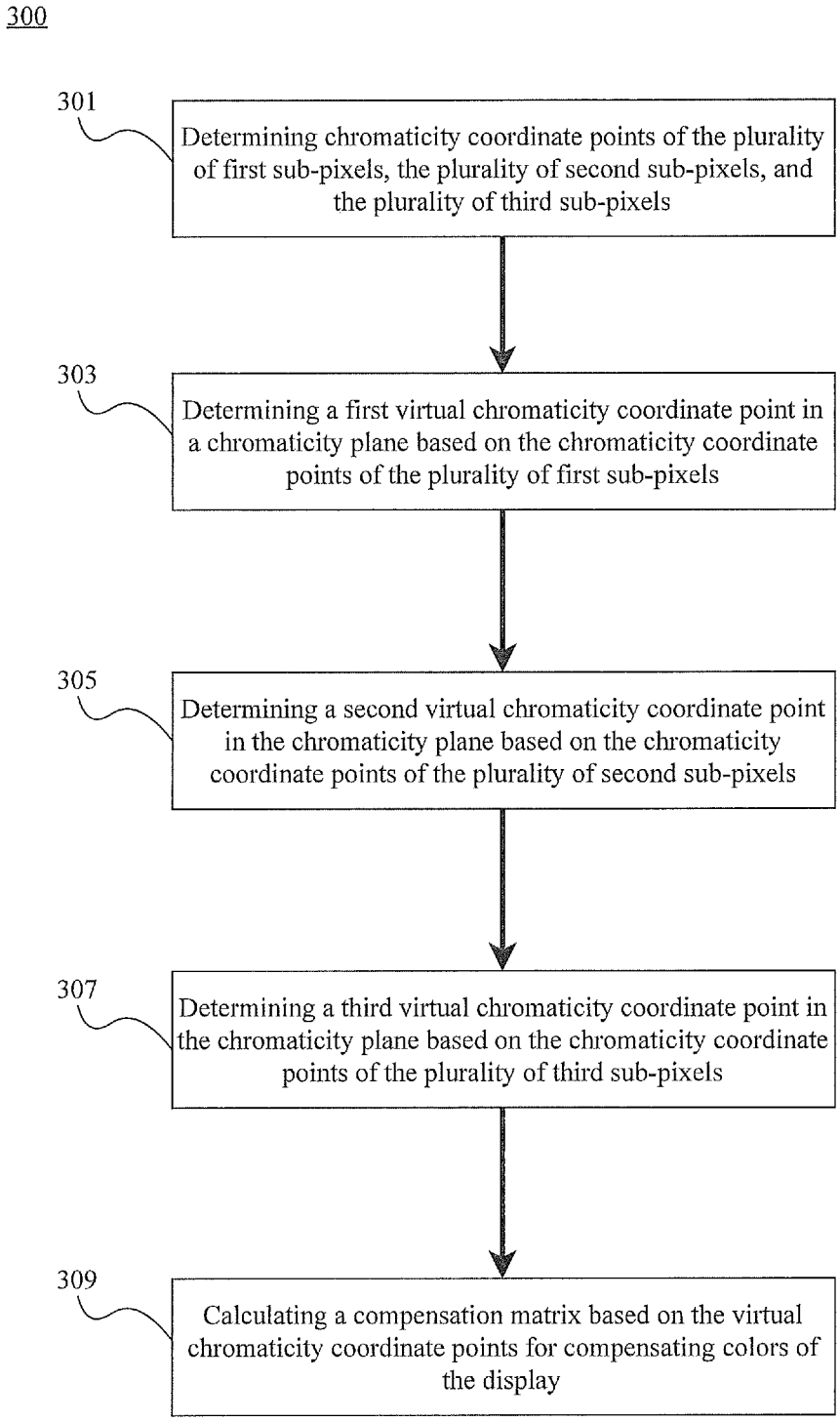
FIG. 3A illustrates a flow chart of a method of compensating colors of a display according to some embodiments of the present disclosure.

FIG. 3A discloses a method 300 of compensating colors of a display according to some embodiments of the present disclosure. The method 300 may be used for the display 100 comprising an array of pixels. The method 300 may include operations for obtaining and analyzing chromaticity data and brightness data and determining preferable virtual color coordinate points. The method 300 may be performed by a computing device. The computing device may receive data from a sensor which can measure or obtain chromaticity data and brightness data of the pixels of the display 100. In the display 100, the pixels in the array may comprise a plurality of first sub-pixels, a plurality of second sub-pixels, and a plurality of third sub-pixels. In some embodiments, the pixels in the array may comprise a plurality of red sub-pixels, a plurality of green sub-pixels, and a plurality of blue sub-pixels. The pixels in the array may comprise a plurality of red sub-pixels, a plurality of green sub-pixels, a plurality of blue sub-pixels, and a plurality of white sub-pixels. The pixels in the array may comprise a plurality of red sub-pixels, a plurality of green sub-pixels, a plurality of blue sub-pixels, and a plurality of yellow sub-pixels.

The method 300 may include operation 301. In operation 301, chromaticity coordinate points of the plurality of first sub-pixels, the plurality of second sub-pixels, and the plurality of third sub-pixels may be determined. One chromaticity coordinate point of one first sub-pixels may be determined by measuring the X, Y, and Z tristimulus values of the first sub-pixel while it is lit. One chromaticity coordinate point of one second sub-pixels may be determined by measuring the X, Y, and Z tristimulus values of the second sub-pixel while it is lit. One chromaticity coordinate point of one third sub-pixels may be determined by measuring the X, Y, and Z tristimulus values of the third sub-pixel while it is lit. A plurality of first sub-pixels can define a first color area on a chromaticity plane. A plurality of second sub-pixels can define a second color area on the chromaticity plane. A plurality of third sub-pixels can define a third color area on the chromaticity plane.

The method 300 may further include operations 303, 305, and 307. In operation 303, a first virtual chromaticity coordinate point on a chromaticity plane is determined based on the chromaticity coordinate points of the plurality of first sub-pixels. In operation 305, a second virtual chromaticity coordinate point on the chromaticity plane is determined based on the chromaticity coordinate points of the plurality of second sub-pixels. In operation 307, a third virtual chromaticity coordinate point on the chromaticity plane is determined based on the chromaticity coordinate points of the plurality of third sub-pixels. The first, second, and third virtual chromaticity coordinate points may form a virtual color gamut for the display 100. The first, second, and third virtual chromaticity coordinate points may indicate three primary colors in the virtual color gamut for the display 100.

The method 300 includes operation 309. In operation 309, based on the three or more virtual chromaticity coordinate points, a compensation matrix can be calculated to compensate colors of the display 100. In some embodiments, based on the three or more virtual chromaticity coordinate points, a compensation matrix for each pixel of the display 100 can be calculated to compensate colors. Based on the three or more virtual chromaticity coordinate points, a compensation matrix for each sub-pixel of each pixel of the display 100 can be calculated to compensate colors.

Figure 3B:
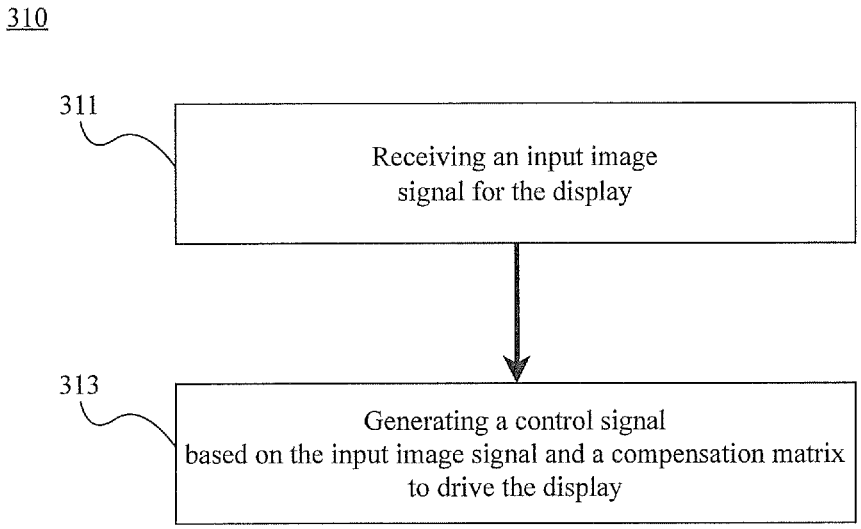
FIG. 3B illustrates a flow chart of a method of compensating colors of a display according to some embodiments of the present disclosure.

FIG. 3B disclose a method 310 of compensating colors of a display according to some embodiments of the present disclosure. The method 310 may include operations 311 and 313.

Referring to FIG. 1B, the compensation matrix may be stored in the storage device 132. In operation 311, an input image signal for the display may be received. Referring to FIG. 1B again, input image data (e.g., including an input image signal) to be displayed can be input to the processor 131 of the display 100.

In operation 313, a control signal to drive the display may be generated based on the input image signal and a compensation matrix. Referring to FIG. 1B again, the processor 131 may transform the input image data (e.g., including an input image signal) into an output image data based on one or more compensation matrices stored in the storage device 132. The input image data may include input values, and each input value may be for one pixel. The processor 131 may transform each input value in the input image data into the corresponding output value based on one or more compensation matrices stored in the storage device 132, combine the corresponding output values into an output image data, and then output the output image data. The display driver 133 may receive the output image data from the processor 131. The display driver 133 may generate control signals for driving pixels of the display panel 110 based on the output values in the received output image data. The display driver 133 may output the control signals to the pixels of the display panel 110 so as to make the pixels emit corresponding color lights based on the control signals.

Figure 4:
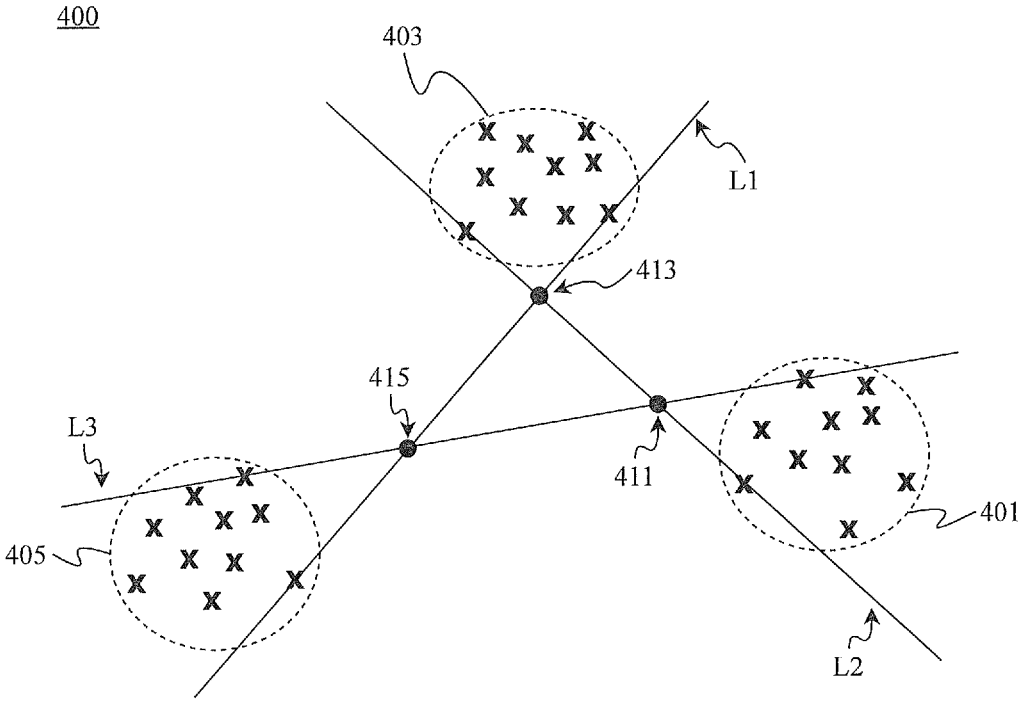
FIG. 4 illustrates a schematic diagram of a chromaticity plane according to some embodiments of the present disclosure.

FIG. 4 illustrates a schematic diagram of a chromaticity plane 400 according to some embodiments of the present disclosure. The chromaticity plane 400 may be a CIE 1931 color space. The chromaticity plane 400 may be included in a CIE 1931 color space. The chromaticity plane 400 may be a projected plane of a CIE 1931 color space.

The cross marks on the chromaticity plane 400 are defined by the sub-pixels of the electronic display 100 according to some embodiments of the present disclosure. The cross marks may be indicated by an x value and a y value on the chromaticity plane 400. The cross marks may be indicated by an x value, a y value, and a luminance value on the chromaticity plane 400. Each cross mark on the chromaticity plane 400 may be determined by measuring the X, Y, and Z tristimulus values of one sub-pixel while it is lit.

The cross marks may be may be divided into multiple groups. In FIG. 4, the cross marks are divided into three groups: 401, 403, and 405. The groups 401, 403, and 405 may thus define three color areas on the chromaticity plane 400. In some embodiments, the three color areas defined by the groups 401, 403, and 405 may belong to red color, green color, and blue color, respectively. The cross marks in the group 401 may be the chromaticity coordinate points of the red sub-pixels. The cross marks in the group 403 may be the chromaticity coordinate points of the green sub-pixels. The cross marks in the group 405 may be the chromaticity coordinate points of the blue sub-pixels.

In some embodiments, based on analyses of the chromaticity coordinate points for three sub-pixels, the three color areas for three sub-pixels may be represented as $(x_1, y_1, V_1, L_{1min})$ $(x_2, y_2, V_2, L_{2min})$ and $(x_3, y_3, V_3, L_{3min})$, where $(x_1, y_1)$, $(x_2, y_2)$, and $(x_3, y_3)$ respectively indicate the center point of the three color areas, $V_1$, $V_2$, and $V_3$ respectively indicate the radii (or variations) of the three color areas, and $L_{1min}$, $L_{2min}$, and $L_{3min}$ respectively indicate the minimum luminance levels (or brightness levels) in the three color areas. For example, based on analyses of the chromaticity coordinate points for red, green, and blue sub-pixels, the three color areas may be represented as $(x_r, y_r, V_r, L_{rmin})$, $(x_g, y_g, V_g, L_{gmin})$, and $(x_b, y_b, V_b, L_{bmin})$, where $(x_r, y_r)$, $(x_g, y_g)$, and $(x_b, y_b)$ respectively indicate the center point of the three color areas, $V_r$, $V_g$, and $V_b$ respectively indicate the radii (or variations) of the three color areas, and $L_{rmin}$, $L_{gmin}$, and $L_{bmin}$ respectively indicate the minimum luminance levels (or brightness levels) in the three color areas.

From the cross marks in the groups 401, 403, and 405, it can be observed that the same sub-pixel of the pixels of the device 100 may not be emitting the same chromaticity levels and/or the same luminance levels. For example, the first sub-pixels of the pixels of the device 100 may not be emitting the same chromaticity levels and/or the same luminance levels, and cross marks in the group 401 are diverse from each other. In some embodiments, it can be observed that the red sub-pixels of the pixels of the device 100 may not be emitting the same chromaticity levels and/or brightness levels, and cross marks in the group 401 are diverse from each other.

In some further embodiments, each pixel of the electronic display 100 may include four sub-pixels. The cross marks defined by the four sub-pixels of the pixels may be divided into four groups on the chromaticity plane 400. The four groups may thus define four color areas on the chromaticity plane 400. In some embodiments, the four color areas defined by the groups may belong to red color, green color, blue color, and white color. The four color areas defined by the groups may belong to red color, green color, blue color, and yellow color.

In some embodiments, three virtual chromaticity coordinate points may be determined based on the groups 401, 403, and 405 in FIG. 4. The groups 401, 403, and 405 may thus define three color areas on the chromaticity plane 400, and three virtual chromaticity coordinate points may be determined based on the three color areas. An exemplary embodiment of the three virtual chromaticity coordinate points may be points 411, 413, and 415. The points 411, 413, and 415 may form a virtual color gamut for the display 100 on the chromaticity plane 400. The points 411, 413, and 415 may indicate three primary colors in the virtual color gamut for the display 100.

In some further embodiments, when each pixel of the electronic display 100 includes four sub-pixels, four virtual chromaticity coordinate points may be determined based on the corresponding four groups on the chromaticity plane 400. When each pixel of the electronic display 100 includes four sub-pixels, the corresponding four groups on the chromaticity plane 400 may define four color areas on the chromaticity plane 400, and four virtual chromaticity coordinate points may be determined based on the four color areas.

According to some embodiments, the points 411, 413, and 415 in FIG. 4 may be defined as the three vertices of a triangle. The triangle defining the points 411, 413, and 415 in FIG. 4 may be determined by lines L1, L2, and L3.

Taking FIG. 4 as an exemplary embodiment, the line L1 may be determined such that the groups 403 and 405 are on one side of the line L1 and the group 401 is on the other side of the line L1. For example, the line L1 is determined such that the groups 403 and 405 are on the left side of the line L1 and the group 401 is on the right side of the line L1. In some embodiments, the line L1 may be determined by one cross mark in the group 403 and one cross mark in the group 405 such that the other cross marks in the groups 403 and 405 are on one side of the line L1 and the group 401 is on the other side of the line L1.

The line L2 may be determined such that the groups 401 and 403 are on one side of the line L2 and the group 405 is on the other side of the line L2. For example, the line L2 is determined such that the groups 401 and 403 are on the right side of the line L2 and the group 405 is on the left side of the line L2. In some embodiments, the line L2 may be determined by one cross mark in the group 401 and one cross mark in the group 403 such that the other cross marks in the groups 401 and 403 are on one side of the line L2 and the group 405 is on the other side of the line L2.

The line L3 may be determined such that the groups 401 and 405 are on one side of the line L3 and the group 403 is on the other side of the line L3. For example, the line L3 is determined such that the groups 401 and 405 are on the lower side of the line L3 and the group 403 is on the upper side of the line L3. In some embodiments, the line L3 may be determined by one cross mark in the group 401 and one cross mark in the group 405 such that the other cross marks in the groups 401 and 405 are on one side of the line L3 and the group 403 is on the other side of the line L3.

As shown FIG. 4, upon determining the lines L1, L2, and L3 a corresponding triangle can be defined. The lines L1, L2, and L3 can be the three sides (or edges) of the triangle. The points 411, 413, and 415 can be the three vertices of the triangle defined by the lines L1, L2, and L3. In some embodiments, the points 411, 413, and 415 can be the three intersection points of the lines L1, L2, and L3.

Figure 5:
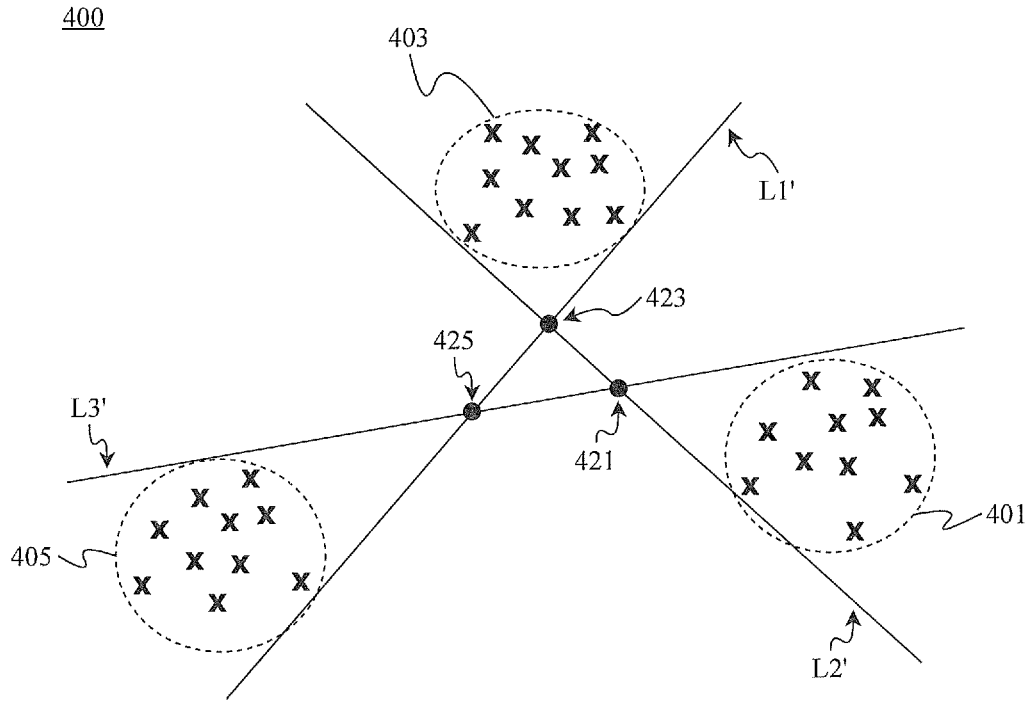
FIG. 5 illustrates a schematic diagram of a chromaticity plane according to some embodiments of the present disclosure.

FIG. 5 illustrates a schematic diagram of a chromaticity plane 400 according to some embodiments of the present disclosure. In FIG. 5, the lines L1, L2, and L3 are moved inwardly to form lines L1', L2', and L3'. The triangle defined by the lines L1', L2', and L3' is smaller than that defined by the lines L1, L2, and L3. The three vertices of the triangle defined by the lines L1', L2', and L3' are points 421, 423, and 425. The points 421, 423, and 425 are closer to each other than the points 411, 413, and 415 are.

In FIG. 4, the points 411, 413, and 415 are the virtual chromaticity coordinate points for the colors indicated by the groups 401, 403, and 405, respectively. For example, when the cross marks in the group 401, 403, and 405 respectively indicate the chromaticity coordinate points for red, green, and blue sub-pixels, the points 411, 413, and 415 are the virtual chromaticity coordinate points for red color, green color, and blue color, respectively. The points 411, 413, and 415 may form a virtual color gamut defined by the corresponding red color, green color, and blue color on the chromaticity plane 400. The points 411, 413, and 415 may indicate the red, green and blue primary colors in the virtual color gamut.

After the virtual chromaticity coordinate points (i.e., the points 411, 413, and 415 in FIG. 4) and the virtual color gamut are determined, the corresponding compensation matrices for each pixel would be calculated or determined. Through the transformations according to the compensation matrices, when the input image data indicates displaying the color of a sub-pixel at some given pixels, the given pixels would be instructed (e.g., by the control circuit 130 or the display driver 133) to display the color of the corresponding virtual chromaticity coordinate point. Through the transformations according to the compensation matrices, when the input image data indicates displaying a color indicated by the group 401, 403, or 405 at some given pixels, the given pixels would be instructed (e.g., by the control circuit 130 or the display driver 133) to display the color indicated by the corresponding virtual chromaticity coordinate point (i.e., the point 411, 413, or 415 in FIG. 4).

For example, if the group 401 indicates the red color of the red sub-pixels, when the input image data indicates displaying the red color at some given pixels, the given pixels would be instructed (e.g., by the control circuit 130 or the display driver 133) to display the color indicated by the corresponding virtual chromaticity coordinate point (i.e., the point 411) through the transformations according to the compensation matrices. If the group 403 indicates the green color of the green sub-pixels, when the input image data indicates displaying the green color at some given pixels, the given pixels would be instructed (e.g., by the control circuit 130 or the display driver 133) to display the color indicated by the corresponding virtual chromaticity coordinate point (i.e., the point 413) through the transformations according to the compensation matrices. If the group 405 indicates the blue color of the blue sub-pixels, when the input image data indicates displaying the blue color at some given pixels, the given pixels would be instructed (e.g., by the control circuit 130 or the display driver 133) to display the color indicated by the corresponding virtual chromaticity coordinate point (i.e., the point 415) through the transformations according to the compensation matrices. Additionally, through the transformation according to the compensation matrices, when the input image data indicates displaying a given color at some given pixels, the given pixels would be instructed (e.g., by the control circuit 130 or the display driver 133) to display the corresponding color in the virtual color gamut. Therefore, the present disclosure can solve the problem of the uneven chromaticity levels and/or uneven luminance levels while displaying any one of the colors of the sub-pixels (e.g., red sub-pixel, green sub-pixel, and blue sub-pixel).

In FIG. 5, the points 421, 423, and 425 are the virtual chromaticity coordinate points for the colors indicated by the groups 401, 403, and 405, respectively. For example, when the cross marks in the group 401, 403, and 405 respectively indicate the chromaticity coordinate points for red, green, and blue sub-pixels, the points 421, 423, and 425 are the virtual chromaticity coordinate points for red color, green color, and blue color, respectively. The points 421, 423, and 425 may form a virtual color gamut defined by the corresponding red color, green color, and blue color on the chromaticity plane 400. The points 421, 423, and 425 may indicate the red, green and blue primary colors in the virtual color gamut.

After the virtual chromaticity coordinate points (i.e., the points 421, 423, and 425 in FIG. 5) and the virtual color gamut are determined, the corresponding compensation matrices for each pixel would be calculated or determined. Through the transformations according to the compensation matrices, when the input image data indicates displaying a color indicated by the group 401, 403, or 405 at some given pixels, the given pixels would be instructed (e.g., by the control circuit 130 or the display driver 133) to display the color indicated by the corresponding virtual chromaticity coordinate point (i.e., the point 421, 423, or 425 in FIG. 5). Additionally, through the transformations according to the compensation matrices, when the input image data indicates displaying a given color at some given pixels, the given pixels would be instructed (e.g., by the control circuit 130 or the display driver 133) to display the corresponding color in the virtual color gamut.

In some embodiments, the fourth virtual chromaticity coordinate point for the fourth sub-pixel can be determined based on the methods of the present disclosure. The four virtual chromaticity coordinate points may form a virtual color gamut on the chromaticity plane 400. After the virtual chromaticity coordinate points (i.e., the points 411, 413, and 415 in FIG. 4) and the virtual color gamut are determined, the corresponding compensation matrices for each pixel would be calculated or determined. When the input image data indicates displaying the color of the fourth sub-pixel (e.g., white sub-pixel or yellow sub-pixel) at some given pixels, the given pixels would be instructed (e.g., by the control circuit 130 or the display driver 133) to display the color indicated by the fourth virtual chromaticity coordinate point. Additionally, through the transformation according to the compensation matrices, when the input image data indicates displaying a given color at some given pixels, the given pixels would be instructed (e.g., by the control circuit 130 or the display driver 133) to display the corresponding color in the virtual color gamut. Therefore, the present disclosure can further solve the problem of the uneven chromaticity levels and/or uneven luminance levels while displaying the color of the fourth sub-pixels (e.g., white sub-pixel or yellow sub-pixel).

Figure 6:
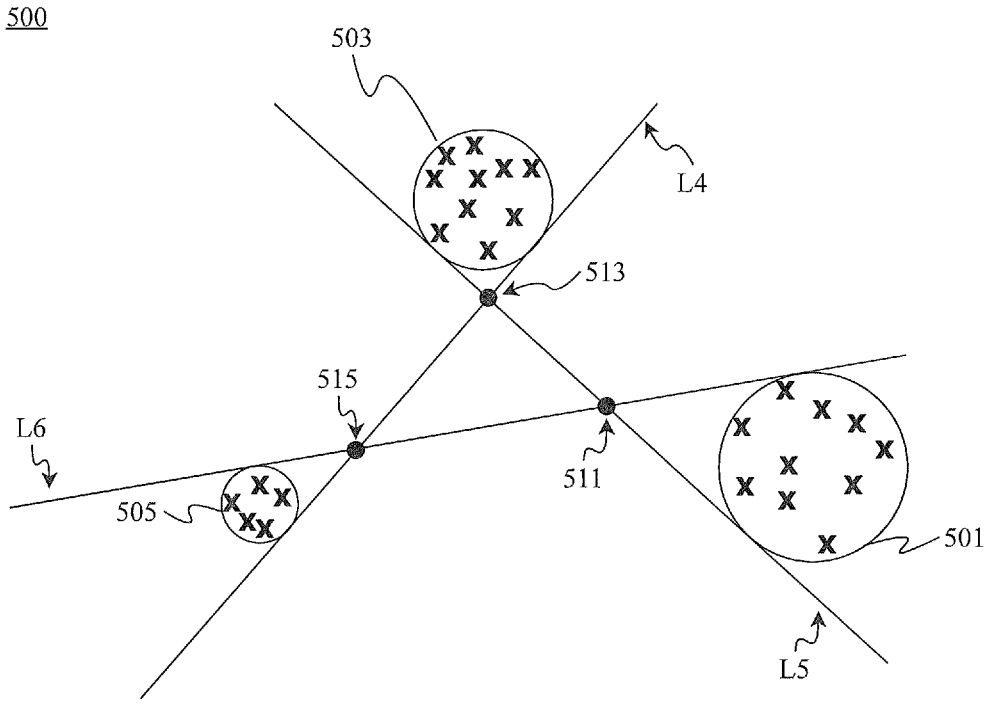
FIG. 6 illustrates a schematic diagram of a chromaticity plane according to some embodiments of the present disclosure.

FIG. 6 illustrates a schematic diagram of a chromaticity plane 500 according to some embodiments of the present disclosure. The chromaticity plane 500 may be a CIE 1931 color space. The chromaticity plane 500 may be included in a CIE 1931 color space. The chromaticity plane 500 may be a projected plane of a CIE 1931 color space.

The cross marks on the chromaticity plane 500 are defined by the sub-pixels of the electronic display 100 according to some embodiments of the present disclosure. The cross marks may be indicated by an x value and a y value on the chromaticity plane 500. The cross marks may be indicated by an x value, a y value, and a luminance value on the chromaticity plane 500. Each cross mark on the chromaticity plane 500 may be determined by measuring the X, Y, and Z tristimulus values of one sub-pixel while it is lit.

The cross marks may be may be divided into multiple groups. In FIG. 6, the three color areas 501, 503, and 505 may be determined by the cross marks. The three color areas 501, 503, and 505 may indicate red color, green color, and blue color, respectively. The cross marks in the color area 501 may be the chromaticity coordinate points of the red sub-pixels. The cross marks in the color area 503 may be the chromaticity coordinate points of the green sub-pixels. The cross marks in the color area 505 may be the chromaticity coordinate points of the blue sub-pixels.

The color areas 501, 503, and 505 may be circles. The color area 501 may be a circle including the chromaticity coordinate points of the corresponding sub-pixels (e.g., red sub-pixels). The color area 503 may be a circle including the chromaticity coordinate points of the corresponding sub-pixels (e.g., green sub-pixels). The color area 505 may be a circle including the chromaticity coordinate points of the corresponding sub-pixels (e.g., blue sub-pixels).

In some embodiments, the color areas 501, 503, and 505 may be represented as $(x_1, y_1, V_1)$, $(x_2, y_2, V_2)$, and $(x_3, y_3, V_3)$, where $(x_1, y_1)$, $(x_2, y_2)$, and $(x_3, y_3)$ respectively indicate the center point of the color areas 501, 503, and 505, $V_1$, $V_2$, and $V_3$ respectively indicate the radii (or variations) of the color areas 501, 503, and 505.

For example, if the color areas 501, 503, and 505 respectively indicate red color, green color, and blue color, the color areas 501, 503, and 505 may be represented $(x_r, y_r, V_r,)$, $(x_g, y_g, V_g,)$, and $(x_b, y_b, V_b,)$, where $(x_r, y_r)$, $(x_g, y_g)$, and $(x_b, y_b)$ respectively indicate the center point of the color areas 501, 503, and 505, $V_r$, $V_g$, and $V_b$ respectively indicate the radii (or variations) of the color areas 501, 503, and 505.

In some embodiments, the color areas 501, 503, and 505 may be represented as $(x_1, y_1, V_1, L_{1min})$ $(x_2, y_2, V_2, L_{2min})$ and $(x_3, y_3, V_3, L_{3min})$, where $(x_1, y_1)$, $(x_2, y_2)$, and $(x_3, y_3)$ respectively indicate the center point of the three color areas, $V_1$, $V_2$, and $V_3$ respectively indicate the radii (or variations) of the three color areas, and $L_{1min}$, $L_{2min}$, and $L_{3min}$ respectively indicate the minimum luminance levels (or brightness levels) in the color areas 501, 503, and 505.

For example, if the color areas 501, 503, and 505 respectively indicate red color, green color, and blue color, the color areas 501, 503, and 505 may be represented $(x_r, y_r, V_r, L_{rmin})$, $(x_g, y_g, V_g, L_{gmin})$, and $(x_b, y_b, V_b, L_{bmin})$, where $(x_r, y_r)$, $(x_g, y_g)$, and $(x_b, y_b)$ respectively indicate the center point of the color areas 501, 503, and 505, $V_r$, $V_g$, and $V_b$ respectively indicate the radii (or variations) of the color areas 501, 503, and 505, and $L_{rmin}$, $L_{gmin}$, and $L_{bmin}$ respectively indicate the minimum luminance levels (or brightness levels) in the color areas 501, 503, and 505.

In some embodiments, the color areas 501, 503, and 505 may be defined by measuring the X, Y, and Z tristimulus values of different sub-pixels of all pixels of the display 100. In other embodiments, the color areas 501, 503, and 505 may be defined by factory specifications of different sub-pixels of all pixels of the display 100. Additionally, the specification of the LEDs in the display 100 may define the corresponding chromaticity coordinate points and illuminance ranges. For example, the specification of the LEDs may specify the values of x, y, and Y in a CIE xyY color space. The color areas 501, 503, and 505 may be obtained based on the values of x, y, and Y in a CIE xyY color space.

In some further embodiments, each pixel of the display 100 may include four sub-pixels. The cross marks defined by the four sub-pixels of the pixels may be divided into four groups on the chromaticity plane 500. The four groups may thus define four color areas on the chromaticity plane 500. In some embodiments, the four color areas defined by the groups may belong to red color, green color, blue color, and white color. The four color areas defined by the groups may belong to red color, green color, blue color, and yellow color.

In some embodiments, three virtual chromaticity coordinate points may be determined based on the color areas 501, 503, and 505 in FIG. 6. An exemplary embodiment of the three virtual chromaticity coordinate points may be points 511, 513, and 515. The points 511, 513, and 515 may form a virtual color gamut for the display 100 on the chromaticity plane 500. The points 511, 513, and 515 may indicate three primary colors in the virtual color gamut for the display 100. The virtual color gamut may be among the color areas 501, 503, and 505 on the chromaticity plane 500. The virtual color gamut may not overlap any of the color areas 501, 503, and 505.

In some further embodiments, when each pixel of the electronic display 100 includes four sub-pixels, four virtual chromaticity coordinate points may be determined based on the corresponding four color areas on the chromaticity plane 500.

According to some embodiments, the points 511, 513, and 515 in FIG. 6 may be defined as the three vertices of a triangle. The triangle defining the points 511, 513, and 515 in FIG. 6 may be determined by lines L4, L5, and L6.

Taking FIG. 6 as an exemplary embodiment, the line L4 may be a common tangent line which is tangent to the color areas (e.g., circles) 503 and 505. The color areas 503 and 505 are on one side of the line L4 and the color area 501 is on the other side of the line L4. For example, the color areas 503 and 505 are on the left side of the line L4 and the color area 501 is on the right side of the line L1.

The line L5 may be a common tangent line which is tangent to the color areas (e.g., circles) 501 and 503. The color areas 501 and 503 are on one side of the line L5 and the color area 505 is on the other side of the line L5. For example, the color areas 501 and 503 are on the right side of the line L5 and the color area 505 is on the left side of the line L5.

The line L6 may be a common tangent line which is tangent to the color areas (e.g., circles) 501 and 505. The color areas 501 and 505 are on one side of the line L6 and the color area 503 is on the other side of the line L6. For example, the color areas 501 and 505 are on the lower side of the line L6 and the color area 503 is on the upper side of the line L6.

As shown FIG. 6, upon determining the lines L4, L5, and L6, a corresponding triangle can be defined. The lines L4, L5 and L6 can be the three sides (or edges) of the triangle. The points 511, 513, and 515 can be the three vertices of the triangle defined by the lines L4, L5, and L6. In some embodiments, the points 511, 513, and 515 can be the three intersection points of the lines L4, L5, and L6.

Figure 7:
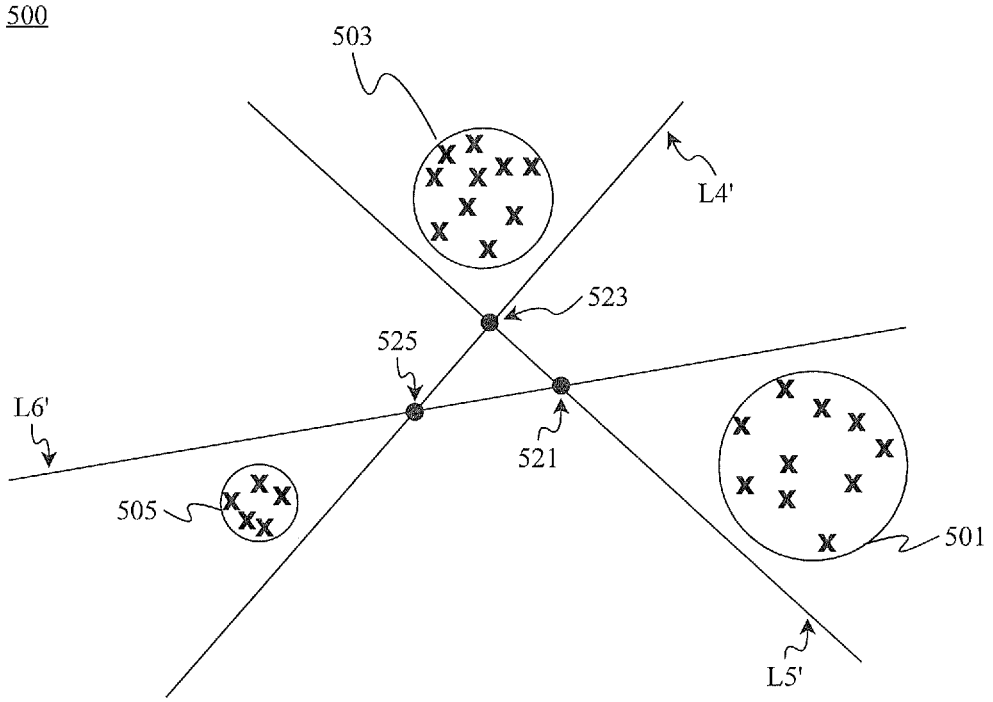
FIG. 7 illustrates a schematic diagram of a chromaticity plane according to some embodiments of the present disclosure.

FIG. 7 illustrates a schematic diagram of a chromaticity plane 500 according to some embodiments of the present disclosure. In FIG. 7, the lines L4, L5, and L6 are moved inwardly to form lines L4', L5', and L6'. The triangle defined by the lines L4', L5', and L6' is smaller than that defined by the lines L4, L5, and L6. The three vertices of the triangle defined by the lines L4', L5', and L6' are points 521, 523, and 525. The points 521, 523, and 525 are closer to each other than the points 511, 513, and 515 are.

In FIG. 6, the points 511, 513, and 515 are the virtual chromaticity coordinate points for the colors indicated by the color areas 501, 503, and 505, respectively. For example, when the cross marks in the color areas 501, 503, and 505 respectively indicate the chromaticity coordinate points for red, green, and blue sub-pixels, the points 511, 513, and 515 are the virtual chromaticity coordinate points for red color, green color, and blue color, respectively. The points 511, 513, and 515 may form a virtual color gamut defined by the corresponding red color, green color, and blue color on the chromaticity plane 400. The points 511, 513, and 515 may indicate the red, green and blue primary colors in the virtual color gamut.

After the virtual chromaticity coordinate points (i.e., the points 511, 513, and 515 in FIG. 6) and the virtual color gamut are determined, the corresponding compensation matrices for each pixel would be calculated or determined. Through the transformations according to the compensation matrices, when the input image data indicates displaying the color of a sub-pixel at some given pixels, the given pixels would be instructed (e.g., by the control circuit 130 or the display driver 133) to display the color of the corresponding virtual chromaticity coordinate point. Through the transformations according to the compensation matrices, when the input image data indicates displaying a color indicated by the color area 501, 503, or 505 at some given pixels, the given pixels would be instructed (e.g., by the control circuit 130 or the display driver 133) to display the color indicated by the corresponding virtual chromaticity coordinate point (i.e., the point 511, 513, or 515 in FIG. 6).

For example, if the color area 501 indicates the red color of the red sub-pixels, when the input image data indicates displaying the red color at some given pixels, the given pixels would be instructed (e.g., by the control circuit 130 or the display driver 133) to display the color indicated by the corresponding virtual chromaticity coordinate point (i.e., the point 511) through the transformations according to the compensation matrices. If the color area 503 indicates the green color of the green sub-pixels, when the input image data indicates displaying the green color at some given pixels, the given pixels would be instructed (e.g., by the control circuit 130 or the display driver 133) to display the color indicated by the corresponding virtual chromaticity coordinate point (i.e., the point 513) through the transformations according to the compensation matrices. If the color area 505 indicates the blue color of the blue sub-pixels, when the input image data indicates displaying the blue color at some given pixels, the given pixels would be instructed (e.g., by the control circuit 130 or the display driver 133) to display the color indicated by the corresponding virtual chromaticity coordinate point (i.e., the point 515) through the transformations according to the compensation matrices. Additionally, through the transformation according to the compensation matrices, when the input image data indicates displaying a given color at some given pixels, the given pixels would be instructed (e.g., by the control circuit 130 or the display driver 133) to display the corresponding color in the virtual color gamut. Therefore, the present disclosure can solve the problem of the uneven chromaticity levels and/or uneven luminance levels while displaying any one of the colors of the sub-pixels (e.g., red sub-pixel, green sub-pixel, and blue sub-pixel).

In FIG. 7, the points 521, 523, and 525 are the virtual chromaticity coordinate points for the colors indicated by the color areas 501, 503, and 505, respectively. For example, when the cross marks in the color areas 501, 503, and 505 respectively indicate the chromaticity coordinate points for red, green, and blue sub-pixels, the points 521, 523, and 525 are the virtual chromaticity coordinate points for red color, green color, and blue color, respectively. The points 521, 523, and 525 may form a virtual color gamut defined by the corresponding red color, green color, and blue color on the chromaticity plane 500. The points 521, 523, and 525 may indicate the red, green and blue primary colors in the virtual color gamut. The virtual color gamut may be among the color areas 501, 503, and 505 on the chromaticity plane 500. The virtual color gamut may not overlap any of the color areas 501, 503, and 505.

After the virtual chromaticity coordinate points (i.e., the points 521, 523, and 525 in FIG. 7) and the virtual color gamut are determined, the corresponding compensation matrices for each pixel would be calculated or determined. Through the transformation according to the compensation matrices, when the input image data indicates displaying a color indicated by the group 501, 503, or 505 at some given pixels, the given pixels would be instructed (e.g., by the control circuit 130 or the display driver 133) to display the color indicated by the corresponding virtual chromaticity coordinate point (i.e., the point 521, 523, or 525 in FIG. 7). Additionally, through the transformations according to the compensation matrices, when the input image data indicates displaying a given color at some given pixels, the given pixels would be instructed (e.g., by the control circuit 130 or the display driver 133) to display the corresponding color in the virtual color gamut.

Equation (1) shows an exemplary compensation matrix M according to some embodiments of the present disclosure. Equation (1) may be associated with the embodiments of FIGS. 3A and 4-7. Equation (1) shows the relationship between an input value for a given pixel, a compensation matrix for the given pixel, and an output value for the given pixel. The input value may be included in input image data. The output value may be included in output image data. Equation (1) may be calculated or processed by the processor 131 of the control circuit 130. The compensation matrix M may be stored in the storage device 132 of the control circuit 130. Based on the output value for the given pixel, the corresponding control signal for the given pixel may be generated and output by the display driver 133 of the control circuit 130.

$$MI = S = \begin{bmatrix} M_{rr} & M_{gr} & M_{br} \\ M_{rg} & M_{gg} & M_{bg} \\ M_{rb} & M_{gb} & M_{bb} \end{bmatrix} \begin{bmatrix} R \\ G \\ B \end{bmatrix} = \begin{bmatrix} S_r \\ S_g \\ S_b \end{bmatrix} \quad \text{Equation (1)}$$

In Equation (1), the matrix I consisting of R, G, and B indicates the input value for a given pixel specified in the input image data. The matrix I consisting of R, G, and B includes red, green, and blue signal values for the red sub-pixel, the green sub-pixel, and the blue sub-pixel of the given pixel specified in the input image data. In particular, R indicates the red signal value for the red sub-pixel of the given pixel, G indicates the green signal value for the green sub-pixel of the given pixel, and B indicates the blue signal value for the blue sub-pixel of the given pixel.

In Equation (1), the matrix S consisting of $S_r$, $S_g$, and $S_b$ indicates the output value for a given pixel. The matrix S consisting of $S_r$, $S_g$, and $S_b$ includes red, green, and blue lighting signal values for the red sub-pixel, the green sub-pixel, and the blue sub-pixel of the given pixel. In particular, $S_r$ indicates the red lighting signal value for lighting the red sub-pixel of the given pixel of the display 100, $S_g$ indicates the green lighting signal value for lighting the green sub-pixel of the given pixel of the display 100, and $S_b$ indicates the blue lighting signal value for lighting the blue sub-pixel of the given pixel of the display 100. Based on $S_r$, $S_g$, and $S_b$ for the given pixel of the display 100, the corresponding control signals for the sub-pixels of the given pixel may be generated and output by the display driver 133 of the control circuit 130.

In Equation (1), the matrix M consisting of $M_{rr}$, $M_{rg}$, $M_{rb}$, $M_{gr}$, $M_{gg}$, $M_{gb}$, $M_{br}$, $M_{bg}$, and $M_{bb}$ indicates the compensation matrix for a given pixel. $M_{rr}$ indicates the amount of red lighting signal value (i.e., $S_r$) necessary for the red signal value (i.e., R). $M_{rg}$ indicates the amount of green lighting signal value (i.e., $S_g$) necessary for the red signal value (i.e., R). $M_{rb}$ indicates the amount of blue lighting signal value (i.e., $S_b$) necessary for the red signal value (i.e., R). $M_{gr}$ indicates the amount of red lighting signal value (i.e., $S_r$) necessary for the green signal value (i.e., G). $M_{gg}$ indicates the amount of green lighting signal value (i.e., $S_g$) necessary for the green signal value (i.e., G). $M_{gb}$ indicates the amount of blue lighting signal value (i.e., $S_b$) necessary for the green signal value (i.e., G). $M_{br}$ indicates the amount of red lighting signal value (i.e., $S_r$) necessary for the blue signal value (i.e., B). $M_{bg}$ indicates the amount of green lighting signal value (i.e., $S_g$) necessary for the blue signal value (i.e., B). $M_{bb}$ indicates the amount of blue lighting signal value (i.e., $S_b$) necessary for the blue signal value (i.e., B). After the virtual chromaticity coordinate points (e.g., the points 411, 413, and 415 in FIG. 4; the points 421, 423, and 425 in FIG. 5; the points 511, 513, and 515 in FIG. 6; or the points 521, 523, and 525 in FIG. 7) and the corresponding virtual color gamut are determined, the compensation matrices M for each pixel can be calculated or determined.

The scope of the present disclosure is not intended to be limited to the particular embodiments of the process, machine, manufacture, and composition of matter, means, methods, steps, and operations described in the specification. As those skilled in the art will readily appreciate from the disclosure of the present disclosure, processes, machines, manufacture, composition of matter, means, methods, steps, or operations presently existing or later to be developed, that perform substantially the same function or achieve substantially the same result as the corresponding embodiments described herein may be utilized according to the present disclosure. Accordingly, the appended claims are intended to include within their scope such processes, machines, manufacture, and compositions of matter, means, methods, steps, or operations. In addition, each claim constitutes a separate embodiment, and the combination of various claims and embodiments are within the scope of the disclosure.

The methods, processes, or operations according to embodiments of the present disclosure can also be implemented on a programmed processor. However, the controllers, flowcharts, and modules may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the flowcharts shown in the figures may be used to implement the processor functions of the present disclosure.

An alternative embodiment preferably implements the methods, processes, or operations according to embodiments of the present disclosure in a non-transitory, computer-readable storage medium storing computer programmable instructions. The instructions are preferably executed by computer-executable components preferably integrated with a network security system. The non-transitory, computer-readable storage medium may be stored on any suitable computer readable media such as RAMs, ROMs, flash memory, EEPROMs, optical storage devices (CD or DVD), hard drives, floppy drives, or any suitable device. The computer-executable component is preferably a processor, but the instructions may alternatively or additionally be executed by any suitable dedicated hardware device. For example, an embodiment of the present disclosure provides a non-transitory, computer-readable storage medium having computer programmable instructions stored therein.

While the present disclosure has been described with specific embodiments thereof, it is evident that many alternatives, modifications, and variations may be apparent to those skilled in the art. For example, various components of the embodiments may be interchanged, added, or substituted in the other embodiments. Also, all of the elements of each figure are not necessary for operation of the disclosed embodiments. For example, one of ordinary skill in the art of the disclosed embodiments would be enabled to make and use the teachings of the present disclosure by simply employing the elements of the independent claims. Accordingly, embodiments of the present disclosure as set forth herein are intended to be illustrative, not limiting. Various changes may be made without departing from the spirit and scope of the present disclosure.

Even though numerous characteristics and advantages of the present disclosure have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An electronic device, comprising:

a display comprising an array of pixels, wherein pixels in the array comprise a plurality of first sub-pixels defining a first color area on a chromaticity plane, a plurality of second sub-pixels defining a second color area on the chromaticity plane, and a plurality of third sub-pixels defining a third color area on the chromaticity plane; and a control circuit, electrically connected to the display, configured to receive an input image signal and generate a control signal to the display for driving each pixel of the display to output light in a virtual color gamut;

wherein the virtual color gamut of the display is among the first, second and third color areas on the chromaticity plane and not overlapping any of the first, second or third color areas, the first color area is represented by a first circle, the second color area is represented by a second circle; and the third color area is represented by a third circle, a center of the first circle is a typical chromaticity coordinate point of the plurality of first sub-pixels and a radius of the first circle is a derivation of the plurality of first sub-pixels, a center of the second circle is a typical chromaticity coordinate point of the plurality of second sub-pixels and a radius of the second circle is a derivation of the plurality of second sub-pixels, and a center of the third circle is a typical chromaticity coordinate point of the plurality of third sub-pixels and a radius of the third circle is a derivation of the plurality of third sub-pixels.

2. The electronic device of claim 1, wherein the plurality of first sub-pixels emit red light, the plurality of second sub-pixels emit green light, and the plurality of third sub-pixels emit blue light.

3. The electronic device of claim 2, wherein each of the pixels in the array further includes a plurality of fourth sub-pixels defining a fourth color area on the chromaticity plane, and the virtual color gamut of the display does not overlap the fourth color area.

4. The electronic device of claim 1, wherein the virtual color gamut of the display is substantially a triangle with a first side, a second side and a third side on the chromaticity plane.

5. The electronic device of claim 1, wherein a first common tangent line being tangent to the second circle and the third circle defines a first side of the triangle; a second common tangent line being tangent to the first circle and the third circle defines a second side of the triangle; and a third common tangent line being tangent to the first circle and the second circle defines a third side of the triangle.

6. The electronic device of claim 1, wherein the first circle encircles substantially all chromaticity coordinate points of the plurality of first sub-pixels, the second circle encircles substantially all chromaticity coordinate points of the plurality of second sub-pixels; and the third circle encircles substantially all chromaticity coordinate points of the plurality of third sub-pixels.

7. A method of operating a display, comprising:

receiving an input image signal for the display; and generating a control signal based on the input image signal and a compensation matrix to drive the display, wherein the display comprises an array of pixels and is configured to output light in a virtual color gamut according to the control signal, wherein pixels in the array comprise a plurality of first sub-pixels defining a first color area on a chromaticity plane, a plurality of second sub-pixels defining a second color area on the chromaticity plane and a plurality of third sub-pixels defining a third color area on the chromaticity plane; and wherein the virtual color gamut of the display is among the first, second and third color areas on the chromaticity plane, and not overlapping any of the first, second or third color areas, the first color area is represented by a first circle, the second color area is represented by a second circle; and the third color area is represented by a third circle, a center of the first circle is a typical chromaticity coordinate point of the plurality of first sub-pixels and a radius of the first circle is a derivation of the plurality of first sub-pixels, a center of the second circle is a typical chromaticity coordinate point of the plurality of second sub-pixels and a radius of the second circle is a derivation of the plurality of second sub-pixels, and a center of the third circle is a typical chromaticity coordinate point of the plurality of third sub-pixels and a radius of the third circle is a derivation of the plurality of third sub-pixels.

8. A method for compensating colors of a display, the display comprising an array of pixels, wherein pixels in the array comprise a plurality of first sub-pixels, a plurality of second sub-pixels and a plurality of third sub-pixels, the method comprising:

determining chromaticity coordinate points of the plurality of first sub-pixels, the plurality of second sub-pixels, and the plurality of third sub-pixels;

determining a first virtual chromaticity coordinate point on a chromaticity plane based on a first color area associated with the chromaticity coordinate points of the plurality of first sub-pixels, determining a second virtual chromaticity coordinate point on the chromaticity plane based on a second color area associated with the chromaticity coordinate points of the plurality of second sub-pixels, and determining a third virtual chromaticity coordinate point on the chromaticity plane based on a third color area associated with the chromaticity coordinate points of the plurality of third sub-pixels, wherein:

the first color area corresponds to a first circle on the chromaticity plane;

the second color area corresponds to a second circle on the chromaticity plane;

the third color area corresponds to a third circle on the chromaticity plane; and a center of the first circle is a typical chromaticity coordinate point of the plurality of first sub-pixels and a radius of the first circle is a derivation of the plurality of first sub-pixels, a center of the second circle is a typical chromaticity coordinate point of the plurality of second sub-pixels and a radius of the second circle is a derivation of the plurality of second sub-pixels, and a center of the third circle is a typical chromaticity coordinate point of the plurality of third sub-pixels and a radius of the third circle is a derivation of the plurality of third sub-pixels; and calculating a compensation matrix based on the virtual chromaticity coordinate points for compensating colors of the display.

9. The method of claim 8, wherein determining the first, second and third virtual chromaticity coordinate points on the chromaticity plane comprises:

determining the first color area associated with the chromaticity coordinate points of the plurality of first sub-pixels;

determining the second color area associated with the chromaticity coordinate points of the plurality of second sub-pixels;

determining the third color area associated with the chromaticity coordinate points of the plurality of third sub-pixels;

determining a triangle on the chromaticity plane among the first, second and third color areas on the chromaticity plane, and not overlapping any of the first, second or third color areas, wherein the vertices of the triangle define the first, second and third virtual chromaticity coordinate points.

10. The method of claim 9, wherein:

a first side of the triangle corresponds to a first common tangent line being tangent to the second circle and the third circle; a second side of the triangle corresponds to a second common tangent line being tangent to the first circle and the third circle, and a third side of the triangle corresponds to a third common tangent line being tangent to the first circle and the second circle.

11. The method of claim 10, wherein the first circle encircles substantially all chromaticity coordinate points of the plurality of first sub-pixels, the second circle encircles substantially all chromaticity coordinate points of the plurality of second sub-pixels; and the third circle encircles substantially all chromaticity coordinate points of the plurality of third sub-pixels.

12. The method of claim 8, wherein determining the first, second and third virtual chromaticity coordinate points on the chromaticity plane comprises:

determining a first line on the chromaticity plane such that the chromaticity coordinate points of the plurality of second sub-pixels and the plurality of third sub-pixels are on one side of the first line and the chromaticity coordinate points of the plurality of first sub-pixels are on the other side of the first line;

determining a second line on the chromaticity plane such that the chromaticity coordinate points of the plurality of first sub-pixels and the plurality of second sub-pixels are on one side of the second line and the chromaticity coordinate points of the plurality of third sub-pixels are on the other side of the second line;

determining a third line on the chromaticity plane such that the chromaticity coordinate points of the plurality of first sub-pixels and the plurality of third sub-pixels are on one side of the third line and the chromaticity coordinate points of the plurality of second sub-pixels are on the other side of the third line;

determining a first intersection point of the second line and the third line as the first virtual chromaticity coordinate point on the chromaticity plane;

determining a second intersection point of the first line and the second line as the second virtual chromaticity coordinate point on the chromaticity plane; and determining a third intersection point of the first line and the third line as the third virtual chromaticity coordinate point on the chromaticity plane.

13. The method of claim 12, wherein:

the first line is determined by a chromaticity coordinate point of one of the plurality of second sub-pixels and a chromaticity coordinate point of one of the plurality of third sub-pixels;

the second line is determined by a chromaticity coordinate point of one of the plurality of first sub-pixels and a chromaticity coordinate point of one of the plurality of second sub-pixels; and the third line is determined by a chromaticity coordinate point of one of the plurality of first sub-pixels and a chromaticity coordinate point of one of the plurality of third sub-pixels.

* * * * *